US005647242A

United States Patent [19]

Saunders

[11] Patent Number: 5,647,242

[45] Date of Patent: *Jul. 15, 1997

[54] FABRICATING ONE-PIECE CAN BODIES WITH CONTROLLED SIDE WALL ELONGATION

[75] Inventor: William T. Saunders, Weirton, W. Va.

[73] Assignee: Weirton Steel Corporation, Weirton, W. Va.

[ * ] Notice: The portion of the term of this patent subsequent to May 14, 2008, has been disclaimed.

[21] Appl. No.: 269,687

[22] Filed: Jul. 1, 1994

Related U.S. Application Data

[60] Division of Ser. No. 596,854, Oct. 12, 1990, Pat. No. 5,343,729, which is a continuation-in-part of Ser. No. 831, 624, Feb. 21, 1986, Pat. No. 5,014,536, which is a continuation-in-part of Ser. No. 712,238, Mar. 15, 1985, abandoned, and a continuation-in-part of Ser. No. 573,548, Aug. 27, 1990, Pat. No. 5,119,657.

[51] Int. Cl.[6] ..... B21D 22/21

[52] U.S. Cl. ..... 72/349; 72/348

[58] Field of Search ..... 72/347, 349, 46

[56] References Cited

U.S. PATENT DOCUMENTS

| | | | |
|---|---|---|---|
| 4,412,440 | 11/1983 | Phalin et al. | 72/349 |
| 4,425,778 | 1/1984 | Franek et al. | 72/349 |
| 4,485,663 | 12/1984 | Gold et al. | 72/347 |
| 4,522,049 | 6/1985 | Clowes | 72/46 |
| 4,584,859 | 4/1986 | Saunders | 72/349 |
| 5,014,536 | 5/1991 | Saunders | 72/349 |
| 5,119,657 | 6/1992 | Saunders | 72/349 |
| 5,347,839 | 9/1994 | Saunders | 72/349 |

*Primary Examiner*—M. Rachuba
*Assistant Examiner*—Donald M. Gurley
*Attorney, Agent, or Firm*—Shanley and Baker

[57] ABSTRACT

New technology for fabricating a one-piece cup-shaped can body is formed free of side wall ironing from can stock comprising flat-rolled sheet metal substrate precoated with protective organic coating and forming lubricant. A plurality of successive diameter-reduction operations are carried out a planar blank and cup-shaped work product during which side wall height is increased and side wall substrate is decreased in thickness to provide controlled uniformity in side wall substrate thickness over about 85% to about 95% of side wall height for such can body. The fabricating tooling provides for a preselected clearance between a punch peripheral wall and a die cavity internal wall in each of such plurality of diameter-reduction operations to achieve a desired decrease in side wall thickness as the precoated substrate is moved into a die cavity by relative movement of its respective punch. In a flat-rolled steel embodiment, one-piece can bodies for carbonated beverage packs require less metal than that currently being used to produce the commercially drawn and ironed product from flat-rolled steel, and can body finishing steps are diminished.

11 Claims, 8 Drawing Sheets

FIG. 4
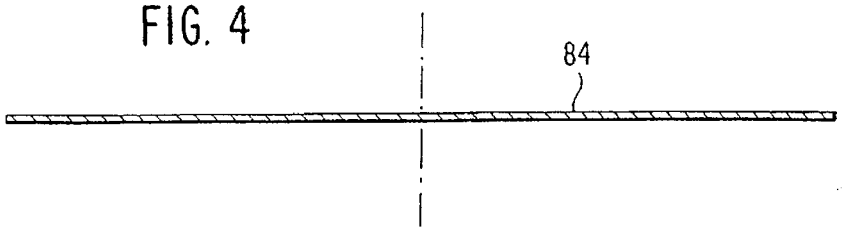
FIG. 5
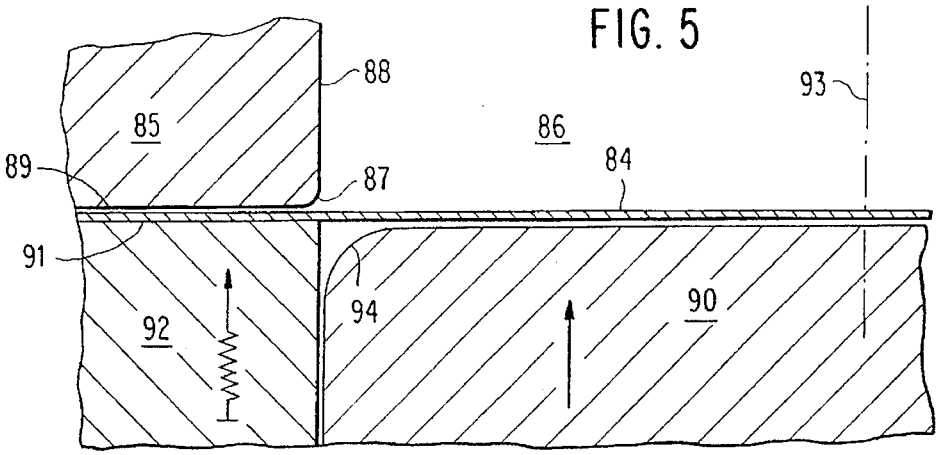
FIG. 6
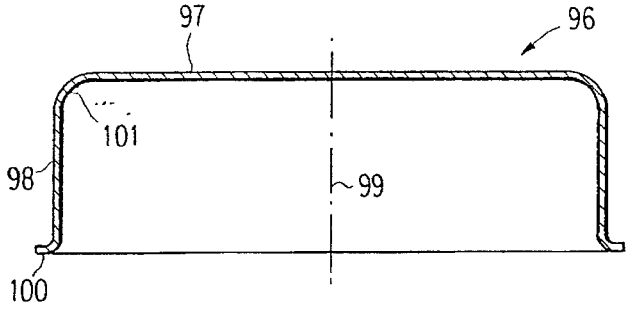
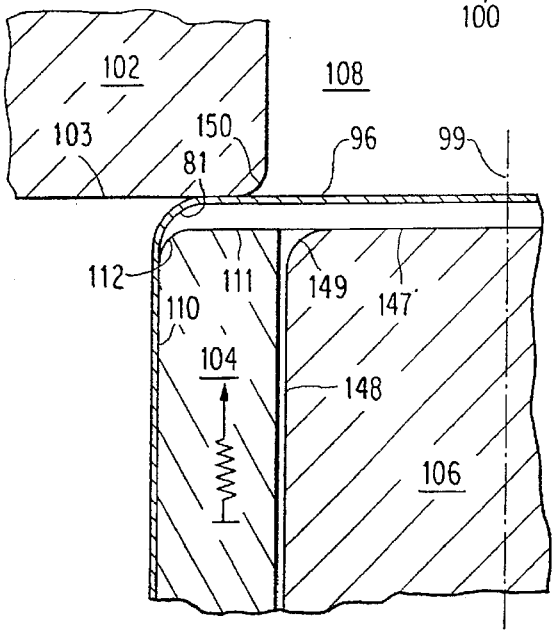
FIG. 7

FIG. 16
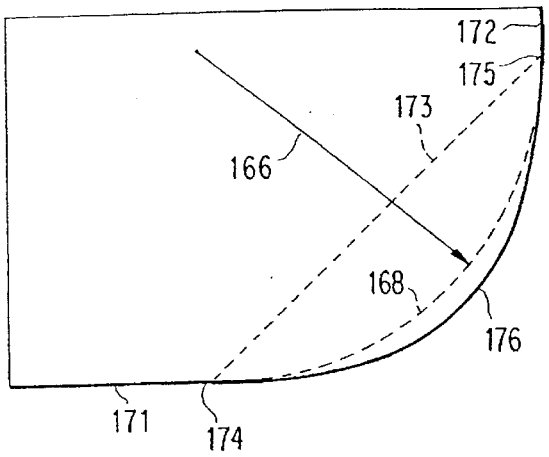
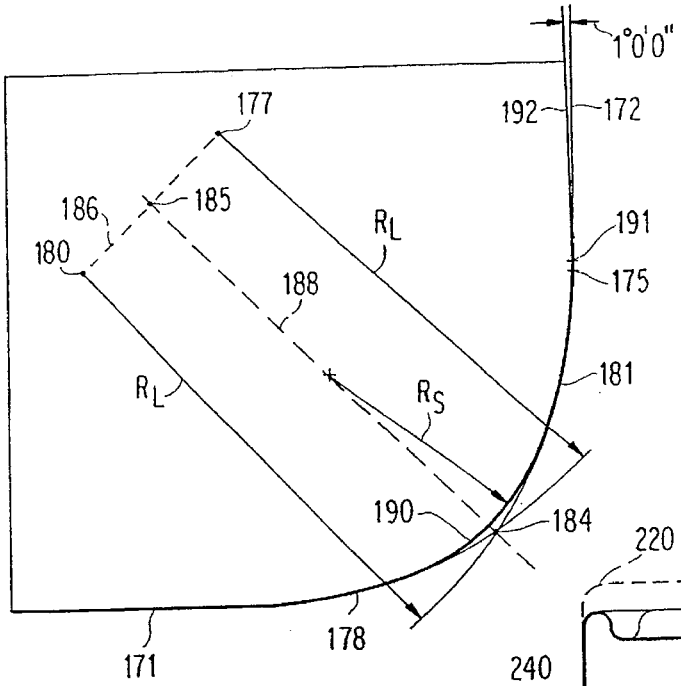
FIG. 17
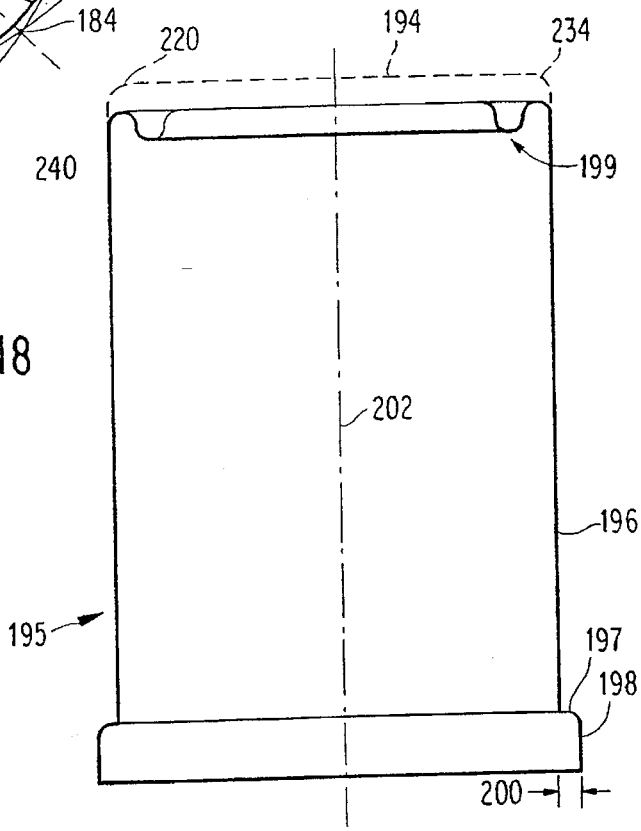
FIG. 18

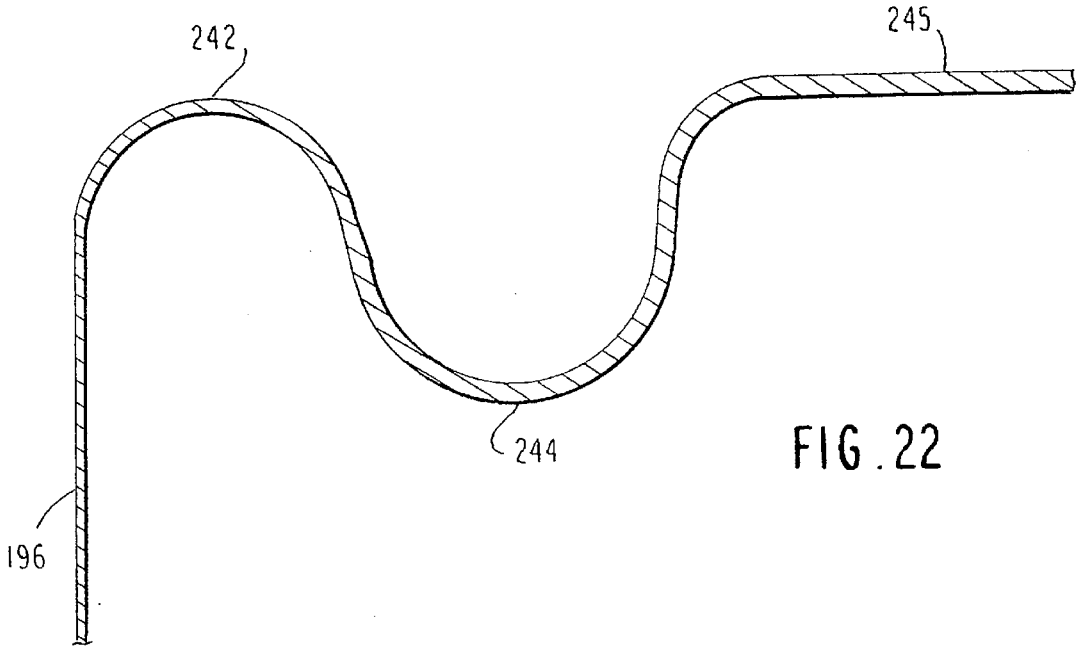
FIG. 22
FIG. 24
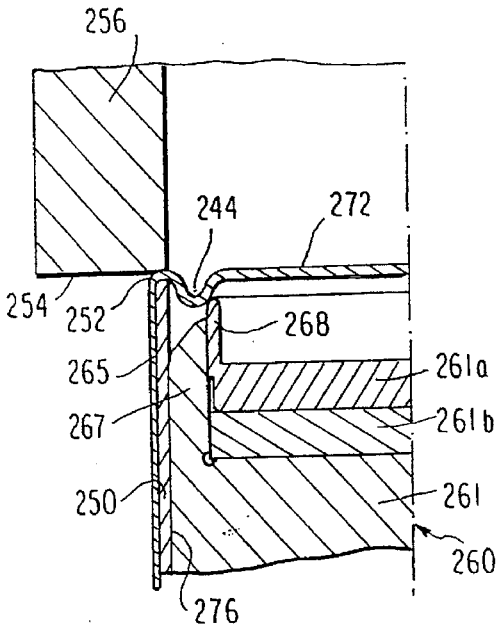
FIG. 25
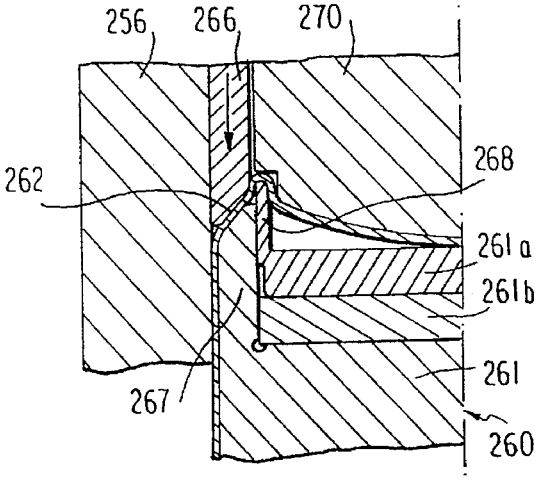

FABRICATING ONE-PIECE CAN BODIES WITH CONTROLLED SIDE WALL ELONGATION

This application is a division of U.S. application Ser. No. 07/596,854 filed Oct. 12, 1990, now U.S. Pat. No. 5,743,729 which is a continuation in part of U.S. application Ser. No. 831,624, "Drawn Can Body Methods, Apparatus and Products" filed by the present applicant Feb. 21, 1986, now U.S. Pat. No. 5,014,536, which was a continuation in part of U.S. application Ser. No. 712,238, "Drawn Can Body Methods, Apparatus and Products" filed Mar. 15, 1985 (now abandoned) U.S. application Ser. No. 07/573,548 entitled "Draw-Process Methods, Systems and Tooling for Fabricating One-Piece Can Bodies" filed by the present applicant on Aug. 27, 1990, now U.S. Pat. No. 5,119,657.

This invention relates to new tooling systems and methods for fabricating one-piece can bodies which provide sheet metal substrate thickness control during a plurality of diameter-reduction operations and a selected uniformity in side wall substrate thickness without relying on side wall ironing. In particular, this invention is concerned with a new system for fabricating flat-rolled sheet metal substrate precoated with organic coating and lubricant while controlling thickness of the substrate to form a new one-piece can body having a protective organic coating on its interior and exterior surfaces as formed. And, in one of its more specific aspects, the invention enables production of can bodice for carbonated beverages which are of lighter weight per can body than those previously produced commercially by "draw and iron" processing of flat-rolled steel can stock.

The metal required per can body is a significant factor in optimizing container costs. Conventional draw-redraw practice increases metal thickness beyond container requirements along the side wall in approaching the open end of a one-piece sheet metal can body. And, when side wall ironing is used in forming one-piece can bodies, heavier gage starting material must be used; as a result the gage of the bottom wall metal in a drawn and ironed can body generally exceeds that required for container purposes.

Another disadvantage is that precoated organic coating cannot be expected to withstand either such side wall thickening or side wall ironing and still provide the integrity required for comestibles.

As taught herein, a one-piece sheet metal substrate can body has protective organic coating as formed in a process which is free of side wall ironing. Sheet metal substrate of predetermined starting gage is precoated with organic coating and lubricant; and, as part of the can body fabrication, side wall sheet metal substrate thickness is controllably decreased relatively uniformly over a selected major portion of side wall height. A specific flat-rolled steel substrate embodiment of the invention provides a structurally and economically practical alternative to the drawn and ironed sheet metal can bodies widely used commercially for carbonated beverage can packs.

These and other advantages and contributions of the invention are considered in more detail in describing aspects of such prior practice and specific embodiments of the invention, as shown in the accompanying drawings.

In such drawings:

FIG. 4 is a schematic cut-edge view of a precoated blank for fabrication in accordance with the invention;

FIG. 5 is a schematic cross-sectional partial view of tooling for forming such blank in accordance with the invention into a shallow-depth one-piece cup-shaped work product with flange about its open end;

FIG. 6 is a cross-sectional view of such cup-shaped work product with flange as completed and ready for delivery open-end down, for travel in the fabricating line;

FIG. 7 is a schematic cross-sectional partial view for describing an operation in accordance with the present invention which is subsequent to FIG. 5;

FIGS. 15, 16 and 17 are schematic, cross-sectional partial views for describing the curved-surface entrance zone between cavity internal wall and planar endwall for die tooling of the present invention;

FIG. 18 is a vertical cross-sectional view in the plane of central longitudinal axis of a specific embodiment for describing operation of the fabricating system of the invention on the work product of FIG. 14 in which side wall gage is controllably decreased during tension-elongation of work product side wall, and for describing closed endwall countersinking in accordance with the invention;

FIG. 22 is an exploded cross-sectional partial view of work product substrate resulting from the endwall countersinking operation of FIG. 21;

FIG. 24 is an enlarged cross-sectional partial view for describing the approach to, and sequence of, closed end clamping and reshaping, and side wall elongation, to form the specific embodiment of FIG. 23;

FIG. 25 is a cross-sectional partial view of work product and tooling for describing completion of the domed endwall and rim metal formation for the pressure pack can body of FIG. 23.

Figure 1:
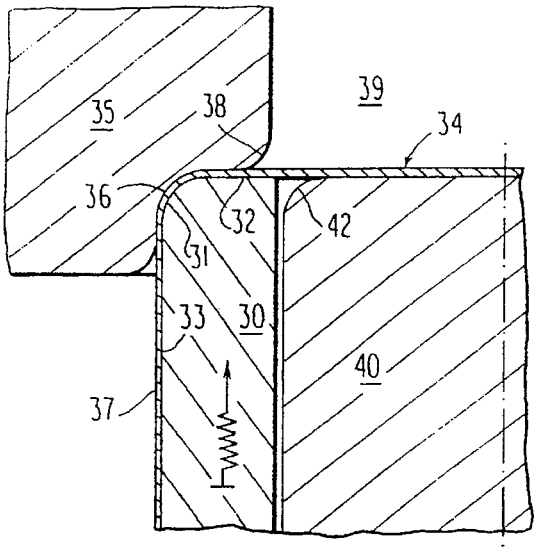
FIG. 1 PRIOR ART
FIGS. 1 and 2 are schematic cross-sectional partial views of conventional redraw tooling which relies on nesting of curved surfaces for sheet metal clamping.

Conventional redraw practice for fabricating one-piece can bodies has relied on "nesting" of curved clamping surfaces, as seen in the cross-sectional view of FIG. 1, on both the interior and exterior of the curved juncture between the endwall and side wall of a cup-shaped work product during redraw of a cup-shaped work product.

Figure 2:
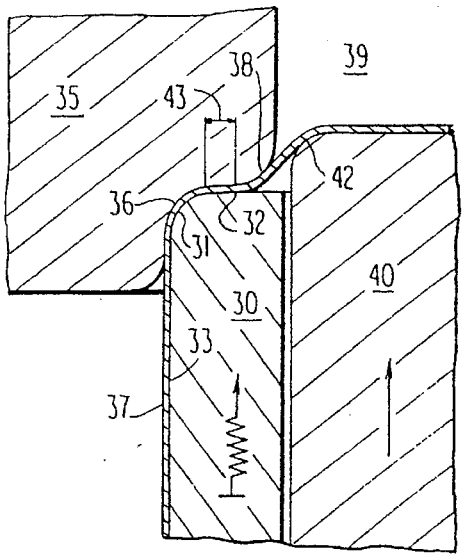
FIG. 2 PRIOR ART

In such practice, clamping sleeve 30 presents a curved transition zone 31 between clamping endwall 32 and clamping sleeve cylindrical side wall 33. The attempt was made to match clamping surface 31 to the internal surface at the juncture between endwall and side wall 37 of the drawn cup 34. Also, redraw die 35 had a curved surface 36 for clamping the exterior surface at the juncture between endwall 32 and side wall 33; such matching was to continue as the sheet metal moved between the curved surfaces 31, 36 toward the die cavity during the redraw of FIG. 2.

In the theoretical "ideal" draw-redraw practice, the surface area of a drawn product does not change as the flat-rolled planar sheet metal of a cut blank, or the endwall of a cup-shaped work product, is drawn into side wall height. However, in practice, the thickness gage of the side wall increases toward its open end as the metal is drawn and redrawn. For example, during conventional draw-redraw practice to form deep-drawn can bodies in which side wall height exceeds diameter, the metal increases as much as 15% to 30% in approaching the open end of the can body.

The conventional draw die cavity entrance (such as 38 of FIGS. 1 and 2 as seen in cross section in a plane which includes the central longitudinal axis of the can body, such axis being shown in interrupted lines) was as large as possible while avoiding wrinkling (or buckle formation) in the sheet metal during movement of draw punch 40 into draw die cavity 39. Further, in such prior practice, the curved surface at the "nose" portion 42 of punch 40 was made as small as possible while avoiding "punch-out" of metal at the start of reshaping a blank or a cup.

For example, in such prior practice, after initial cup formation, typical radius of curvature dimensions for each such curved surface if used to form a can body for 211×400 can ($2^{11}/_{16}$" diameter by 4" height) would be as follows:

| | |
|---|---|
| clamping sleeve surface 31 | .125" |
| cavity entrance surface 38 | .070" |
| "punch-nose" surface 42 | .125" |
| draw die surface 36 | .135" |

However, such conventional draw-redraw means thickened the sheet metal in approaching the open end of the can body. And, side wall ironing is not a good option because the cold forging characteristics of ironing were detrimental to the precoating of an organic coating.

Figure 3:
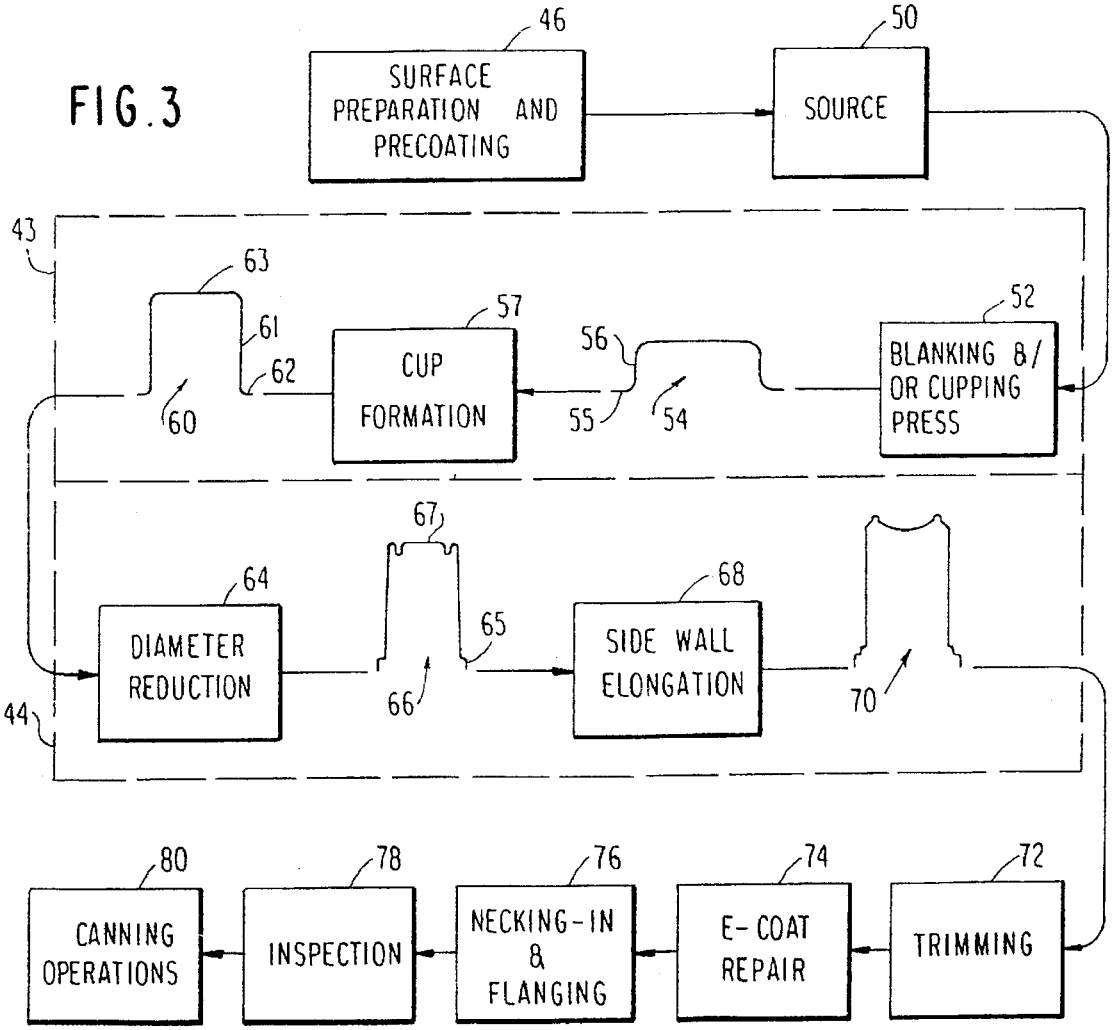
FIG. 3 is a diagrammatic general-arrangement presentation for describing a specific embodiment of the new processing system of the invention for in-line fabrication of one-piece can bodies.

The fabricating system shown schematically in the general arrangement of FIG. 3 not only avoids thickening of side wall substrate while the diameter of a cup-shaped work product is progressively decreased in a plurality of sequential operations but also controls substrate thickness throughout such work product. In addition, the invention controllably decreases side wall substrate gage along side wall height free of side wall ironing. The result is a "thinned side wall" can body produced by controllably regulating tension in the substrate during side wall elongation.

A relatively uniform decrease in side wall gage is achieved in each of a plurality of interrelated diameter-reduction operations. In a first phase of a specific embodiment (outlined by interrupted line 43 in FIG. 3), the diameter of a can stock blank is changed in two operations so as to form a cup-shaped work product of significantly decreased side wall diameter with relatively minor decreases in side wall gage. In a second phase of such specific embodiment (outlined by interrupted line 44 in FIG. 3), side wall thickness gage is more significantly decreased as side wall metal is elongated under increased tension with relatively minor changes in cup-shaped work product diameter. A one-piece can body with a side wall of controlled and lighter gage throughout its height is thus produced. The process significantly increases surface area of the work product over that of the starting blank as the side wall is elongated under tension, free of any side wall ironing.

Flat-rolled sheet metal of predetermined gage and surface characteristics is provided for producing the tension-elongated, thinned side wall, one-piece can bodies of the fabricating system shown diagrammatically in FIG. 3. Such sheet metal substrate is precoated on both its surfaces with organic coating and lubricant. The production operational rate of the fabricating system is preferably kept independent of the precoating preparation production rate.

The organic coating applied to a surface-prepared sheet metal substrate embodies a "blooming compound"; that is, a lubricant which is activated by the heat and/or pressure of fabrication. And, the invention further provides for surface precoating of a lubricant which can be the type used for drawing can bodies. The precoated organic coating and lubricants (integral blooming compound and surface applied) are preselected, in particular for the internal surface of containers for comestibles, to meet requirements of governmental regulatory agencies such as the U.S. Food and Drug Administration.

The blooming compound incorporated in the organic coating and surface-applied augmenting lubrication are selected for each prepared surface; preferably, application of lubricant to the surface of the organic coating is carried out as part of coil precoat processing. Total lubricant coating weight on each surface is preselected in the range of about 15 to 20 mg/sq. ft. Fabricating line speed is kept independent of surface preparation line speed. However, lubrication requirements to meet fabricating stress on the public-side surface of the can stock differ from lubrication requirements on the product-side surface. And, organic coating requirements to maintain maximum product protection on such product-side surface can differ from organic coating objectives for the public-side surface. The present processing enables selective precoating required for product and/or public side surfaces and maintains the integrity of such coating during fabrication of the one-piece can bodies. Where carbonated beverage container specifications have required dual-stage treatment and lacquering of the product-side surface of a drawn and ironed can body, an internal spray coat or surface E-coat repair may suffice with the present processing and, such repair may not be necessary for many container products. The multiple stage washing and multiple surface coating finishing operations required of draw and iron processing are significantly diminished, with certain of such finishing operations being eliminated entirely because the protective characteristics of the precoated organic coating are substantially sustained on the interior and exterior of the can body during forming for most comestibles.

Copending parent patent application U.S. Ser. No. 0/673,548 entitled "Draw-Process Methods, Systems and Tooling for Fabricating One-Piece Can Bodies," filed by the present applicant Aug. 27, 1990, is incorporated herein to provide more detail on surface preparation practices for preparing flat-rolled steel as a substrate and, on organic polymeric materials used as a protective organic coating for specific embodiments of the present invention. Use of dual organic coating systems on sheet metal substrate and preselected coating weights for each surface, incorporating blooming compound and following up with preselected augmentation by surface lubrication, can be expected to provide sufficient protective organic coating integrity for the side wall thinning, diameter-reduction operations described herein; need for internal surface repair, if any, would likely be limited to internal side wall portions for certain container packs.

For present purposes, the flat-rolled sheet metal is preferably work hardened. Double-reduced flat-rolled steel (see *Making, Shaping and Treating Steel,* 9th Ed., 1971, page 971 ©AISE, printed by Herbick & Held, Pittsburgh, Pa.) is a preferred composition for a flat-rolled steel specific embodiment; carbon content is decreased from conventional tin mill product practice of around 0.12% carbon to less than 0.02% C, with a range such as about 0.002% C to about 0.01% C being preferable. And, manganese would preferably be decreased from the conventional tin mill product range (about 0.6%) to less than 0.2% Mn; for example, in a range of about 0.1% to about 0.2% Mn. Such compositions facilitate the tension-elongation stretching of side wall substrate taught herein.

Referring to FIG. 3, surface preparation and precoating are carried out at 46. Organic coating and lubricant precoating are described in more detail in applicant's copending U.S. application Ser. No. 07/573,366 entitled "Composite-Coated Flat-Rolled Sheet Metal Manufacture and Product," filed on Aug. 27, 1990, and is incorporated herein by reference. Depending on end product and side wall gage reduction, surface coating for the "product-side" can be in the range of about 10 to about 20 mg/in$^2$.

Precoated flat-rolled can stock is accumulated at source 50; for example, coiled continuous strip, or a moving strip accumulator, can be provided in a manner to keep can stock preparation rate independent of fabricating line speed. Alternatively, can stock can be accumulated and supplied from source 50 to the fabricating line in cut sheet or blank form.

Station 52 can comprise a blanking and cupping press into which continuous-strip or sheets are fed; or, alternatively, can comprise a cupping press into which cut blanks are fed. Using either alternative, a relatively shallow-depth, one-piece cup-shaped work product 54, with a flange 55 at the open end of side wall 56, is formed. In the specific embodiment, the diameter of the blank is decreased about thirty-five percent in forming the diameter for side wall 56 in such cupping operation.

Cup formation and a subsequent diameter reduction of cup 54 at station 57 are carried out to avoid increase in the side wall thickness gage. Avoiding increase in the gage of the side wall substrate is an important contribution to the control of side wall gage during side wall elongation.

In the specific embodiment, side wall diameter for a one-piece can body is, to a large extent, established in a two step first phase. For example, a blank cut edge diameter of about 5.875" (for forming a final can body side wall diameter of 2.581") is formed in two diameter reduction operations into work product 60 having a side wall diameter of about 2.986". That is, cut edge diameter is decreased about 50% or more in such first phase while sheet metal substrate thickness in side wall 61 (excluding flange 62) is decreased only about 15%. Forming flange 62 at the open end of work product 60 establishes uniform side wall height along with providing other advantages. In a plurality of successive diameter-reduction operations, the diameter of a circular cut blank is decreased about one-third to provide the side wall diameter for the shallow-depth cup-shaped work product 54; such side wall diameter of the shallow-depth cup is then decreased about 25% at the second diameter reduction station 57 to produce work product cup 60 with side wall 61, open end flange 62 and closed endwall 63.

In a controlled portion of the closed endwall the thickness gage is maintained at starting gage throughout the tension-regulated elongation of the side wall with diameter-reduction taught herein. For example, the planar portion of the closed endwall remains at starting gage in the first diameter reduction operation of the specific embodiment at cupping station 52 and in the second operation at station 57. The side wall gage, in such specific embodiment, is decreased by a relatively minor and uniform amount during such first phase while the substrate of the curved surface juncture between closed endwall and side wall is in transition; that is, decreasing from such starting gage of the endwall to such uniform side wall gage.

Flange 55 at the open end of shallow cup 54, and flange 62 at the open end of side wall 61, are oriented in a plane which is transverse (at or near perpendicular) to the central longitudinal axis of the work product; that is, the flange is properly oriented to support the work product for travel in the fabricating line. In a second fabricating phase (44) of the specific embodiment, greater elongations of the work product side wall under higher tensions are carried out with relatively minor diameter reductions. And, special measures are employed to provide for planar clamping of substantially solely uniform thickness gage material to enable higher-tension, greater side wall elongation notwithstanding the small surface areas of clamping due to such minor diameter-reductions in each of two higher-tension side wall elongation operations of such second phase.

Utilizing double-reduced sixty-five pound per base box flat-rolled steel for fabricating a twelve ounce carbonated beverage can body, the cut blank diameter is decreased about 35% in forming shallow cup 54. In the specific embodiment, the side wall diameter (3.882") of shallow cup 54 is decreased about 25% to form work product 60 having a diameter of 2.986". In two subsequent higher-tension side wall elongation diameter-reduction operations of the illustrated embodiment, the diameter of the side wall is decreased in the range of about 2.5% to about 10% while the side wall is more significantly elongated and side wall thickness is more significantly decreased than in the two operations of the first phase.

From station 57 (FIG. 3), the cup-shaped work product 60 travels open end down on flange 62 to station 64 for reshaping work product 60 in a third diameter-reduction operation in which side wall elongation is followed by a special countersinking of the endwall; the latter is preferably carried out in the same press station (64).

In the specific embodiment, the diameter reduction in station 64 is less than in previous stations; for example, about 13% in processing such twelve ounce pressure-pack can body. A major portion of the clamping action is carried out on the substantially uniform gage side wall of the reshaped work product from station 57; then, upon completion of such first higher-tension side wall elongation of station 64, and upon release of clamping action, countersinking is carried out on the closed endwall. As shown in later FIGS., such countersinking returns at least that portion of the work product juncture substrate which is thicker than the relatively uniform thickness of the side wall just completed, such portion of such contiguous side wall is moved into the endwall. The result after such countersinking is that the uniform side wall gage from the operation at station 64 extends along side wall height into the curved surface juncture (where clamping will next occur) and into the closed endwall.

At the open end of the work product, the small diameter flange (resulting from the small side wall diameter-reduction change at station 64), and the contiguous metal 65 leading to the open end of work product 66, will subsequently be removed by trimming. A portion of such clamped flange and/or such contiguous metal 65 to be removed will be at a thicker gage than the side wall of the just completed operation.

The elongated side wall work product 66, with countersunk endwall 67, is then transferred for a further high-tension elongation of the side wall in a successive side wall diameter-reduction operation to be carried out at station 68 (FIG. 3). The minor diameter decrease is reflected in a small open end flange. Such small flange, and the contiguous metal leading to the open end, do not generally provide sufficient planar surface for adequate or stable support of a work product on its open end for in-line travel; therefore, other mechanical handling of work product, such as known side wall clasping techniques, can be used for work product transfer between stations 64 and 68, and subsequent thereto if required in-line.

Trimming at the open end of can body 70 is carried out at station 72; which in a specific embodiment is carried out in a manner to provide for beverage can formation. That is, the entire flange and contiguous metal leading to the open end are removed prior to station 74 where E-coat repair of the internal surface is carried out if required. Necking-in and flanging (utilizing commercially available apparatus) is carried out at station 76 prior to inspection at test station 78. Subsequent canning operations, such as filling and applying an end closure, can be carried out at station 80.

The present invention eliminates several finishing steps required when fabrication of one-piece can bodies relies on side wall ironing. For example, the present invention eliminates (a) required washing of ironing lubricant from the can body, (b) external side wall protective coating, and (c) external base and bottom "rim" coating. Also, the internal surface lacquering (and curing) required by current ironing practice on beverage can bodies may be eliminated for certain products; repair of side wall internal surface, if required, is more readily adapted to being carried out in line.

The fabricating steps of the specific embodiment are considered in greater detail starting with FIG. 4. Cut blank 84 is cut from can stock in which flat-rolled sheet metal substrate of predetermined thickness gage has been precoated; such blank has a predetermined cut edge diameter. In the cross-sectional partial view of cupping tooling in FIG. 5, cupping die 85 defines die cavity 86 with entrance zone 87 between its internal side wall 88 and planar clamping surface 89. Male punch 90 moves relative to die cavity 86, as indicated, as the blank 84 is clamped peripherally externally of male punch 90 between planar clamping surface 89 of die 85 and planar surface 91 of clamping sleeve 92. Such planar clamping surfaces are oriented transversely to central longitudinal axis 93 at or near perpendicular to such axis.

The cavity entrance zone 87, as viewed in vertical cross section (that is, in a plane which includes the central longitudinal axis 93), has a curved surface formed about a small radius of curvature to provide a "sharp edge" for multi-directional movement of can stock from a planar configuration into the die cavity. The radial projection of such cupping tooling cavity entrance zone on the clamping plane is about five times nominal sheet metal substrate starting gage.

However, cavity entrance zone 87 is, preferably, formed about multiple radii of curvature. As described later in more detail, use of multiple radii of curvature increases curved-surface area of the cavity entrance zone without increasing such projection on the clamping plane surface. Designation of the use of multiple radii is indicated herein by setting forth the multiple radii used; in the specific embodiment, the multiple radii used for the cavity entrance zone 87 are about 0.05"/0.02"/0.05"; such mid-surface radius of about 0.02" provides a sharper edge configuration about which the can stock moves into the die cavity which is an important aspect in achieving the uniformity of side wall gage reduction and the extent of such reduction. Also, cavity wall 88 is slightly tapered to provide increasing diameter with increasing depth of such cavity.

More uniform side wall gage over substantially full side wall height is facilitated by such cavity entrance measures and by selectively decreasing clearance, for such side wall diameter reduction operation, between the peripheral side wall of the punch and the cavity internal wall (at such entrance zone) to less than the gage of the substrate being elongated. As taught herein, selection of such clearance helps to control tension-elongation and the selected thickness uniformity along side wall height. For example, in the specific embodiment with a starting gage of 0.0072" double-reduced steel, a clearance of about 0.007" (measured radially in cross section)provided around the circumference in the cupping die provides a sidewall gage of about 0.0066" which is relatively uniform throughout side wall height between the closed endwall juncture and the open end flange. Such clearance is preselected in the plurality of successive diameter-reduction operations.

Curved surface 94 at the peripheral (nose) portion of punch 90 is formed about as large a radius of curvature as can be used without causing buckling or wrinkling in the substrate, for the cupping operation. A punch nose radius of curvature of 0.300" (which is about forty times nominal starting gage) is used for cupping during fabrication of the above-mentioned can body for a twelve ounce beverage can using double-reduced sixty-five pound per base box precoated flat-rolled steel. Such large punch nose helps to overcome sheet metal inertia at the start of shaping a curvilinear side wall from flat-rolled substrate.

Cup 96 (FIG. 6) includes endwall 97, side wall 98 which is symmetrical in relation to central longitudinal axis 99, flange 100 in a plane which is at or near perpendicularly transverse to axis 99, and juncture 101 between endwall 97 and side wall 98. Juncture 101 has a curved configuration in vertical cross section conforming to that of punch nose 94 of FIG. 5 which is formed about such 0.300 radius of curvature.

During cup forming, central longitudinal axis 99 for cup 96 is coincident with central longitudinal axis 93 for the die; relative movement between tooling is carried out with such tool components being oriented in symmetrical relationships to axis 93.

During subsequent diameter reductions of work product, curved clamping surfaces are eliminated and solely planar clamping is relied on. Also, the curved-surface juncture between the closed endwall and side wall of the work product (e.g. cup 96) is first reshaped about a smaller curved peripheral surface of the clamping tool. The start of such juncture reshaping is carried out in a manner which creates a force on the work product closed endwall metal which is directed in a transverse plane in a direction away from the central longitudinal axis (99). The importance of such reshaping of the curved-surface shallow-cup juncture (as well as in subsequent can body forming operations) is that reshaping the juncture adds to the surface area of the can stock available for clamping between planar surfaces during formation of a new cross section for the work product.

FIG. 7 shows the juxtaposition of cup 96 with tooling approaching the closed endwall juncture prior to such juncture reshaping. Die 102 can be considered as stationary for purposes of understanding reshaping of the juncture of a cup-shaped work product—it being understood that required relative movement between tooling components is carried out with their centerline axes coincident.

It should also be noted that, in practice, such relative movement between upper and lower tooling is preferably selected so as to discharge the work product on to the pass line (travel path for the work product) without requiring removal of work product from tooling cavities or punch; and, without the necessity of accumulating work product off line for later reintroduction to the fabricating line. In the apparatus shown, the open end of the cup is oriented downwardly during formation for discharge of the work product for travel open end down in the pass line; travel from the first two press stations is carried out on the flange of each respective work product.

The invention teaches use of a flat-faced die as shown in FIG. 7 (and also later illustrated dies). That is, die 102 presents solely planar clamping surface 103 and such planar clamping surface lies in a plane which is oriented to be transverse to central longitudinal axis 99. When such dies are made from sinter-hardened machineable material, such as tungsten carbide, and the clamping surface area is extended as in the first phase of the specific embodiment, a taper is provided between the planar clamping surfaces. For example, surface 103 can be tapered (opening outwardly) a fraction of a degree (such as about a half degree) to facilitate movement of the can stock along such surface toward the cavity; for further details on use of taper with sinter-hardened tooling, see applicant's copending application Ser. No. 07/490,781 entitled "Draw-Process Methods, Systems and Tooling for Fabricating One-Piece Can Bodies."

Axially-movable clamping tool 104 has a sleeve-like configuration and is disposed to circumscribe male punch 106. The male punch is adapted to move can stock into cavity 108 as defined by die 102. The clearance between the internal wall of cavity 108 and the peripheral wall of punch 106 is selectively decreased in relation to the starting gage. Radial clearance about the circumference for cupping 65#/bb (0.0072") double-reduced flat-rolled steel of the specific embodiment can be selected at about 90% of substrate thickness, for example, between 0.0064" and 0.0068"; stated otherwise, such radial-clearance about the punch is about 5% to about 10% less than substrate thickness. Elongation of the can stock by movement around the cavity entrance zone into such decreased clearance of the die cavity increases tension in the side wall substrate; the substrate is deceased in thickness by elongation under tension about the sharp edge of the cavity entrance zone by movement of the punch into the die cavity. The result is a more uniform decrease in side wall gage along side wall height between juncture and flange of the cup. The work product side wall substrate gage is decreased about 10% to about 20% in station 57 of FIG. 3; that is, to a thickness gage in the range of about 0.006" to about 0.0055" in such specific embodiment.

Referring to FIG. 7, clamping sleeve 104 includes peripheral wall 110, planar endwall 111 and curved-surface transition zone 112 therebetween. The dimension of peripheral wall 110 of clamping sleeve 104 provides an allowance for tool clearance of about 0.0025" in relation to the internal side wall (98, FIG. 6) dimension of a work product cup (96).

The surface area of transition zone 112 of clamping sleeve 104 is significantly smaller than one-half the surface area of juncture 101 of cup 96; for example, about one fourth to about one-half. That is, in a specific embodiment, a projection of the transition zone 112 onto a clamping surface plane which is perpendicularly transverse to the central longitudinal axis occupies less than about 40% of the projection of cup juncture 101 on such plane. The interrelationship of these curved surfaces is selected to provide a difference of at least 60% in their radial projections on the transverse clamping plane; this translates into a corresponding increase in planar clamping surface area when juncture 101 of cup 96 is reshaped about transition zone 112 (prior to otherwise starting metal movement into the die cavity due to movement of the punch). Reshaping of a work product juncture is shown and described in relation to FIGS. 8 through 11.

In a specific cylindrical-configuration side wall embodiment for sizes set forth above, the transition zone surface on the cupping punch uses a 0.300" radius of curvature to form cup juncture 101 so that the projection of such juncture on the transverse clamping plane is 0.300". The projection of transition zone 112 of the clamping sleeve curved surface using multiple radii of curvature teachings (as described in FIGS. 8–11) occupies 0.071" rather than the original 0.300" radius. This provides a radial difference of about 75%; that is, a projection of the clamping sleeve transition zone 112 onto the transverse clamping plane occupies less than about 25% of the projection of the 0.300" radius of curvature surface of juncture 101. Reshaping of the cup juncture thus significantly increases the planar clamping surface area (in which the clamping sleeve surface coacts with the planar clamping surface 103 of die 102); this feature is used in each operation in which a new diameter is formed.

Figure 8:
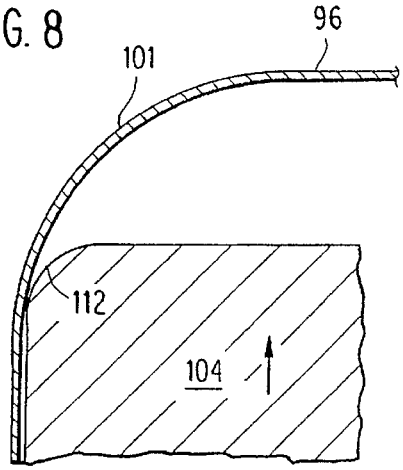
FIGS. 8 through 11 are enlarged cross-sectional partial views of clamping tooling and work product for describing reshaping of the curved-surface juncture between the endwall and side wall of a cup-shaped work product in order to increase planar clamping surface during side wall elongation.
Figure 9:
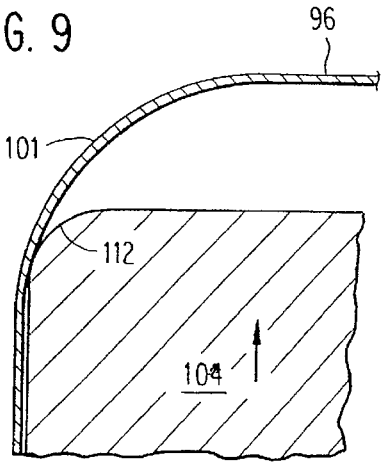
Figure 10:
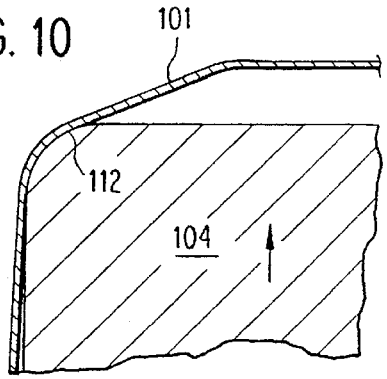
Figure 11:
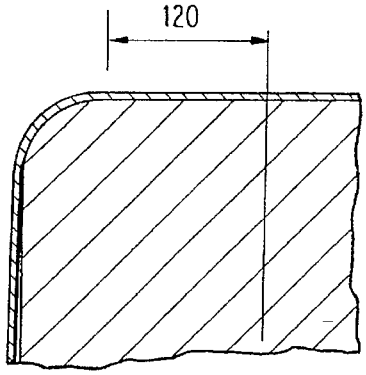

Referring to FIG. 8, as clamping sleeve 104 is moved against spring-loaded pressure its curved surface transition zone 112 comes into contact with the inner surface of juncture 101 of cup 96. With continued relative movement (FIG. 9) an outwardly directed (away from the central longitudinal axis) force is exerted on the sheet metal of cup 96 as juncture 101 is formed about a smaller radius of curvature (FIG. 9). Upon completion of such juncture reshaping (FIG. 11) the can stock now available for clamping between planar clamping surfaces for forming a new diameter side wall has been substantially increased. And, clamping takes place solely over such extended planar surface area between the die planar clamping surface such as 103 of FIG. 7 and the clamping sleeve planar surface 111. The increase in planar clamping surface area over that previously available, due to such controlled reshaping of a work product juncture is indicated at 120 in FIG. 11.

Such increased planar clamping surface is added to that made available by the earlier mentioned contribution of the invention which deceases the die cavity entrance zone surface; a smaller cavity entrance zone surface (described in more detail in relation to later FIGS.) increases the planar clamping surface area of the die for coaction with the planar surface of the clamping tool. Such die cavity entrance projection is from about five to about 0.5 times substrate gage in the sequence of operations. Combining the effect of reshaping the cup juncture and use of a smaller cavity entrance zone projection increases the planar clamping surface available by a factor of at least two over that available for corresponding can body sizes using conventional draw-redraw tooling.

Also, the clamping sleeve peripheral transition zone (as viewed in cross section) (124) is preferably manufactured about multiple radii. As described in relation to FIG. 12, a single radius of curvature for the clamping sleeve peripheral transition zone surface (as viewed in cross section) about a radius "R" would result in a projection on the transverse clamping plane of clamping endwall 126 dimensionally equal to "R". In place of such single radius, such curved surface is formed about multiple radii of curvature through selective usage of "large" and "small" radii of curvature in forming a curved surface transition zone for the clamping tool.

Figure 12:
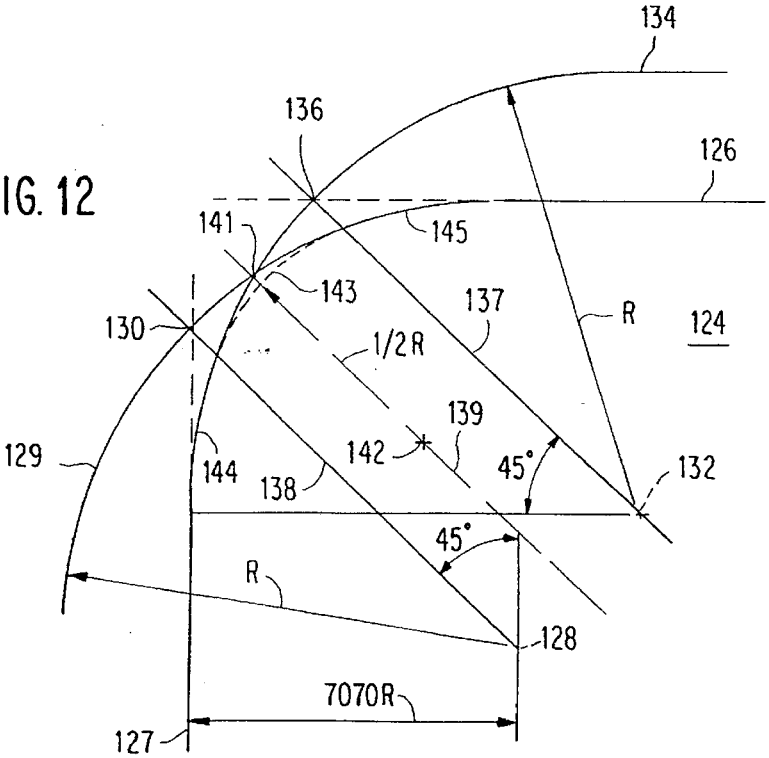
FIG. 12 is an illustration for describing manufacture of such a clamping sleeve transition zone surface between endwall and side wall of a clamping tool for use in reshaping a work product juncture as described in relation to FIGS. 8 through 11.

In FIG. 12, clamping sleeve 124 includes a planar endwall 126 which is transverse to the centerline axis of the cup; clamping sleeve 124 also includes a peripheral side wall 127. In preferred fabrication of the curved surface transition zone for the clamping tool, a "large" radius R is used about center 128 to establish circular arc 129 which is tangent to the planar endwall surface 126. Extending circular arc 129 through 45° intersects with the extended plane of peripheral side wall 127 at imaginary point 130.

Using the radius R about center 132 establishes circular arc 134 tangent to side wall 127; extending arc 134 through 45° intersects the transverse clamping plane of endwall 126 at imaginary point 136.

Straight line 137 is drawn between imaginary point 136 and center 132; straight line 138 is drawn between imaginary point 130 and center 128; interrupted line 139 is drawn so as to be equidistant between parallel lines 137 and 138. Line 139 comprises the loci of points for the center of a "small" radius of curvature which will be tangent to both the circular arcs 129 and 134 so as to avoid an abrupt surface intersection at imaginary point 141. Using a radius of ½ R with its center 142 along line 139, circular arc 143 is drawn to complete a smooth, multiple radii curved surface for the transition zone of clamping sleeve 124.

As a result of the clamping tool design of FIG. 12, the projection of the multiple radii curved surface on the transverse clamping plane of endwall 126 is 0.0707 times R, resulting in further increase of almost 30% in the planar clamping surface over that available if a single radius R were used for the curved surface transition zone of clamping sleeve 124. Also, a more gradual curved entrance surface 144 into the transition zone is provided; and, a more gradual curved surface 145 from the transition zone onto the clamping surface 126 is provided. Curved surface 144 also provides for easier entrance of the clamping tool transition zone into contact with the internal surface of the curved juncture of a cup-shaped work product for such juncture reshaping step.

In a specific cylindrical configuration embodiment for a multiple radii clamping sleeve transition zone for reshaping a 0.300" radius of curvature juncture for work product cup 96, R is selected to be 0.100"; therefore, the projection of clamping sleeve multiple radii transition zone on the transverse clamping plane comprises 0.0707" rounded off as 0.071". Other values for R can be selected; for example, a 1.25" radius of curvature for reshaping a cup juncture of substantially greater radius than 0.300"; or 0.9" for reshaping a smaller radius of curvature juncture; in general selecting R as 0.100" will provide desired results throughout the preferred commercial range of can sizes designated earlier.

Figure 13:
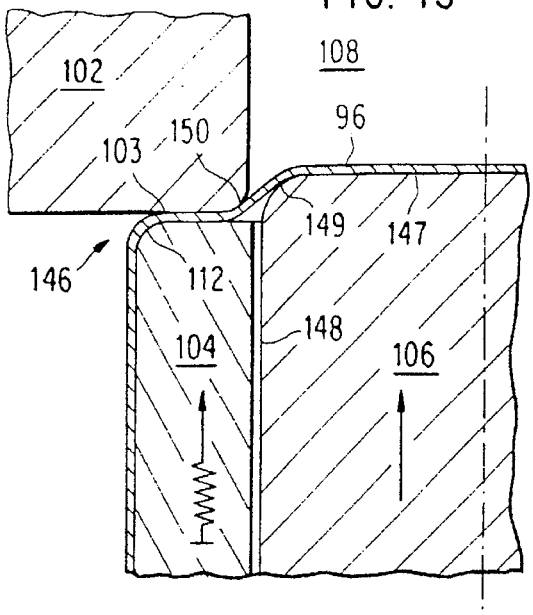
FIG. 13 is a schematic, cross-sectional partial view of the tooling of FIG. 7 as a new work product cross section is being formed and the cup side wall is being elongated.

As shown in cross section in FIG. 13, a funnel-shaped configuration 146 is established between planar surface 103 of die 102 and clamping sleeve transition zone 112 for movement of work product can stock into the axially transverse clamping plane without damage to the coating as male punch 106 moves into cavity 108. A further relief can be provided by having surface 103 diverge away from the clamping plane at a location which is external (in a direction away from axis 99 designated in FIG. 7) of the planar clamping surface.

Male punch 106 includes endwall 147, peripheral side wall 148 and curved surface transition zone 149 between such endwall and side wall. A large surface area is provided at transition zone 149 (the punch nose) to the extent permitted by geometry requirements at the closed endwall juncture in later stages of the work product to facilitate starting each new diameter side wall. Coaction between such large surface area punch nose formed about a 0.200" radius of curvature for diameter reduction of the shallow-depth cup 96 (stage 57 of FIG. 3) in the specific example; also, a small projection cavity entrance zone surface 150 is used, preferably, formed about multiple radii of curvature 0.050"/0.020"/0.050" for increasing the planar clamping surface area for such diameter reduction stage. Such aspects also combine in subsequent stages to continue the control of the decrease in side wall gage initiated during the cupping stage. These measures also help to prevent damage ("galling") of organic coating surfaces.

In accordance with teachings of the present invention, any significant increase in thickness gage of the side wall substrate is avoided during decrease in blank diameter and subsequent decreases in side wall diameter; and, side wall gage is controllably decreased in each such operation. From the cupping and second such operation (first phase) of the specific embodiment relatively uniform gage side wall substrate is made available for later higher tension, greater side wall elongation operations.

In a specific embodiment of such later operations, a portion of the substrate contiguous to the periphery of the closed end of the can body is used to provide a differing gage substrate to form a "bottom rim" about the closed endwall and extending to the can body side wall. Also, differing gage substrate is provided near the open end for flanging purposes; whereas, relatively uniform lighter gage side wall substrate is provided therebetween as described in more detail later herein. However, it should be noted that the side wall thickness control provided does not refer to the heavier gage portions of the flange and contiguous can stock leading to the open end of a can body (which may be of heavier gage than the finished relatively uniform gage portion of the side wall); such flange and contiguous portions are removed by trimming for purposes of fabricating carbonated beverage can bodies in the specific embodiment being described.

The punch-nose radius after the cupping operation is selected to be about thirty times starting metal thickness gage in the second diameter reduction operation of the specific embodiment for a twelve ounce beverage can using 65#/bb double-reduced TFS. That is, the radius of curvature for the punch-nose is about 0.200"; TFS refers to the tin free coating of chrome and chrome oxide applied to flat-rolled steel as a surfactant for later application of protective organic coating.

The curved surface for the peripheral transition zone of the clamping tool uses the multiple radii of curvature teachings described earlier; for example, a surface which projects as 0.071" on the transverse clamping plane can be used during the second redraw in reshaping such first redraw curved surface juncture of the work product (which has an internal surface radius of curvature of 0.200"); or, a new surface based on R=0.1" can be used in forming the multiple radii transition zone for the second redraw clamping tool as described above.

Figure 14:
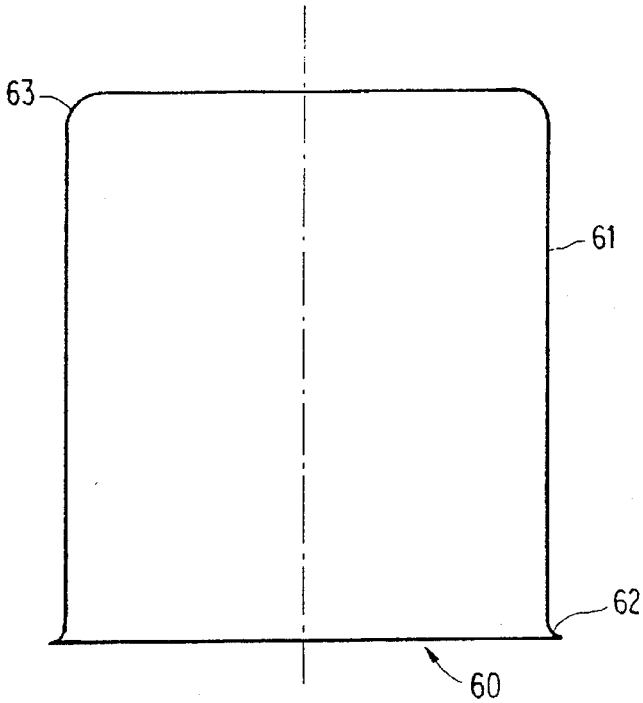
FIG. 14 is a schematic cross-sectional view of the cup-shaped work product with flange resulting from a diameter-reduction operation in accordance with the invention following the cupping operation of FIG. 5.

FIG. 13 shows the apparatus of FIG. 7 during formation of a new side wall cross section. Tooling dimensions for a cylindrical-configuration one-piece can body for twelve ounce carbonated beverage can, using precoated 65#/bb flat-rolled double reduced TFS, in accordance with the invention are as follows:

| Radii Curvature | Work Product Diameter | Punch-Nose Radius | Cavity Diameter | Multiple for Cavity Entrance |
|---|---|---|---|---|
| Circular blank | 5.875" | — | — | — |
| Shallow cup (FIG. 6) .05"/.02"/.05" | 3.882" | .300" | 3.896" | — |
| Second cup (FIG. 14) .05"/.02"/.05" | 2.986" | .200" | 2.998" | — |

Punch and die cavity clearances in such cupping phase are approximately equal to desired side wall sheet metal thickness, for example, about 0.007" per side (radial cross section). Use of such clearance stretches side wall substrate to provide a relatively uniform substrate gage of about 0.0066" along such side wall.

In the twelve ounce cylindrical can body embodiment, the diameter of a circular sheet metal blank is decreased about 34.2% during cupping. And, the shallow cup work product side wall diameter is decreased about 23% in the second operation; radial clearance of about 0.006" can be selected for such second diameter-reduction operation.

The multiple radii of curvature shaping of the die cavity entrance zone is combined with tapering of the cavity internal wall to help eliminate adherence of can stock to the die cavity internal wall. The multi-directional movement required of the metal substrate in establishing a new cross sectional area can result in a type of "spring-back" action in the overall product side wall. Such recessed taper for the internal wall surface of the die cavity, along with other aspects, helps minimize or substantially eliminate galling of the outer surface organic coating.

Figure 15:
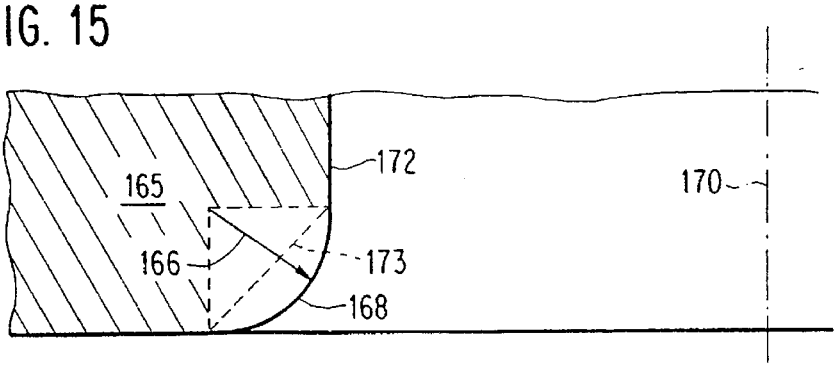

FIG. 15 is an enlarged vertical cross-sectional partial view of a cavity entrance zone for die 165 formed about a single radius of curvature 166, selected in accordance with earlier presented teachings (about five times sheet metal starting gage for the cupping stage and decreasing in subsequent operations). Single radius curved surface 168 for the entrance cavity is spaced from central longitudinal axis 170 and extends symmetrically between planar clamping surface 171 and internal side wall surface 172. Curved surface 168 is tangential (as viewed in such cross section) at each end of its 90° arc; that is, tangential to planar surface 171 and to the cavity internal surface 172, respectively.

In FIG. 16, such curved surface 168 (about single radius of curvature 166 of FIG. 16) is shown as an interrupted line; a 45° angle line 173, between the planar clamping surface and cavity side wall, is also shown by an interrupted line. Such 45° angle line 173 meets the respective points of tangency of single radius curved surface 168 with the planar clamping surface 171 at 174 and the internal side wall 172 at 175. The planar clamping surface 171 and the cavity internal surface 172 (as represented in cross section) would, if extended, define an included angle of 90°.

A larger surface area 176 (FIG. 16) for the entrance zone is provided by the present invention. The multiple radii cavity entrance zone concept is carried out, in the specific embodiment being described, by selecting a radius of about 0.050" as the "larger" radius (RL) for the multiple radii surface. Placement of such larger radii (RL, FIG. 17) surface provides for the more gradual movement of can stock from the planar clamping surface into the cavity entrance zone and, also, for the more gradual movement from the entrance zone into the interior side wall of the cavity.

A smaller radius (Rs) for the specific embodiment, selected at about 0.020", is used to establish a curved surface which is intermediate such larger radius (RL) portions located at the arcuate ends of the entrance zone surface. That is, the Rs surface is centrally located of such entrance zone. The interior cavity wall 172 is recessed slightly, about one-half degree to about 1°, in progressing from the curved surface entrance zone into the cavity.

A portion (178) of the curved surface 176 of FIG. 16 is formed in FIG. 17 about center 177 and uses the larger radius RL (0.050"); such surface portion 178 is tangential to the planar clamping surface 171 of the draw die. Such larger radius is used about center 180 to provide curvilinear surface 181 leading into the internal side wall of the cavity.

To derive the loci of points for the centrally located smaller radius (Rs) of curvature portion of the curved surface, the arcs of the larger radii surfaces 178, 181 are extended to establish an imaginary point 184 at their intersection. Connecting imaginary point 184 with midpoint 185 of an imaginary line 186 between the RL centers 177, 180 provides the remaining point for establishing the loci of points (line 188) for the center of the smaller radius (Rs) of curvature; the latter will provide a curvilinear surface 190 which is tangential to both larger radius (RL) curvilinear surfaces 178 and 181. In the specific embodiment for a twelve ounce beverage can body, the larger radius (RL) of curvature is selected at about 0.05" (in a range of 0.040" to 0.060") and, the smaller radius (Rs) of curvature is selected at about 0.02" (in the range of 0.015" to 0.025"). A specific example for the cupping cavity entrance zone and the second operation cavity entrance zone is 0.050"/0.020"/0.050"; a specific example for the later higher-tension operations which provide increased side wall elongation and gage reduction is 0.012"/0.003"/0.012".

In such multiple radii configurations, the smaller radius (Rs) curved surface is located intermediate the two larger (RL) surfaces, e.g. 0.05"/0.02"/0.05", and, provides the edge about which the can stock is moved into the cavity as the side wall is stretched for passage through the preselected clearance.

In order to provide a 1° recessed taper (FIG. 17) for the die cavity internal surface, the arc between the planar clamping surface and such internal surface is increased by 1°; such 1° arc increase being added at the internal surface end of the arc. Such added 1° of arc enables such internal surface to be tangent to the curved surface at point 191; that is, 1° beyond the 90° point of tangency (175). A tangential recess-tapered internal side wall cannot be provided without such added arc provision as described immediately above. The location of a 1° taper internal side wall surface, in a vertically oriented plane which includes the central longitudinal axis of the draw cavity, is shown at line 192 in relation to a non-tapered side wall surface indicated by line 172.

In the specific embodiment of flat-rolled steel can body for a twelve ounce carbonated beverage can, can body weight is less than that required by draw and iron processing of a can body having the same dimensions; for example, steel can bodies in accordance with the invention result in a weight of about fifty-three pounds per thousand can bodies compared to a weight of about fifty-eight pounds per thousand drawn and ironed steel can bodies.

The second phase (FIG. 3) is carried out in multiple reshaping operations. In each stage a relatively minor diameter reduction is utilizes while side wall gage is deceased significantly as the side wall is significantly elongated. Several measures are taught to enable accomplishing such objectives: (a) providing for planar clamping of more uniform thickness can stock substantially throughout clamping metal, (b) minimizing the decease in side wall diameter in each stage, and (c) controlling clearance between the punch peripheral wall and the internal wall entering die cavity.

The closed endwall 194, shown in interrupted lines in FIG. 18, is an intermediate configuration of the work product endwall during the third diameter-reduction operation in the specific embodiment of the fabricating system (carried out at station 64 of FIG. 3). That is, interrupted line 194 of FIG. 18 depicts the closed endwall configuration before endwall countersinking. Work product 195 of FIG. 18 includes elongated side wall 196, flange 197 and flange associated metal 198 leading to the open end of work product 195. The resulting countersunk endwall is shown in a solid line at 199. The radial dimension of the flange is represented at 200 which also represents the radial decrease in side wall cross section. The central longitudinal axis is represented at 202.

Figure 19:
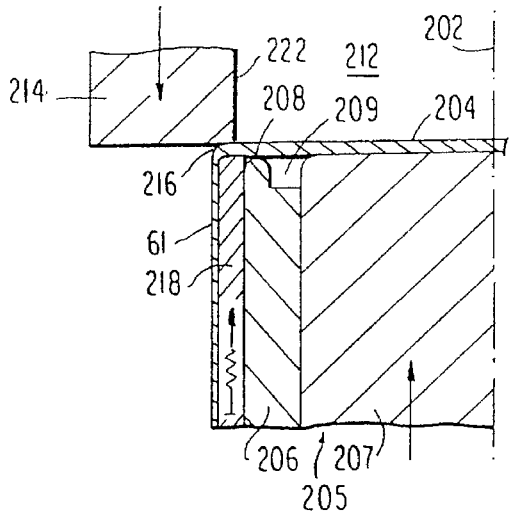
FIGS. 19, 20 and 21 are enlarged cross-sectional partial views of tooling and work product for purposes of describing the start of (FIG. 19) and progress through (FIG. 20) such side wall elongation and describing countersinking of the endwall (FIG. 21) to form the work product of FIG. 18.

FIG. 19 shows the juxtaposition of tooling for starting the operation resulting in work product 195 of FIG. 18. The closed end of the work product 60 from station 57 of FIG. 3 (after reshaping of the juncture) is identified as 204; an integral punch 205 comprises a core 206 and an insert 207 which are joined. Use of such parts (which are bolted together to form the integral punch) makes machining easier; such parts act as a unitary punch during fabrication. Such integral punch defines a recessed contour 209 in its endwall; the latter is utilized in later countersinking of endwall 194 to form endwall 199 (FIG. 18).

Punch 205 is moving toward the cavity 212 defined by die 214 in FIG. 19 with relative movement of tooling components as indicated. The juncture between endwall 63 and side wall 61 of work product 60 (FIG. 3) has been reshaped to form a new juncture 216 for increased planar clamping (as described earlier) by clamping tool 218. A portion of the endwall 204, represented by the planar portion of width 200 of flange 197 in FIG. 18 can therefore include the start of "transition thickness" metal between endwall 63 and side wall 61 from such juncture which is initially clamped between the planar surfaces of die 214 and clamping sleeve 218. Such substrate is in transition to the side wall (61) gage resulting from the operation at station 57 (FIG. 3). Side wall 61 is free of any significant increase in thickness throughout its height (which does not include the flange 62). Such side wall thickness is less than starting gage and is of relatively uniform thickness with such thickness dimension depending on the tooling selected for such previous station (57). Thus, reshaped juncture 216 can be of varying thicknesses in going from endwall gage through a portion of the "transition thickness" metal of such juncture.

Figure 20:
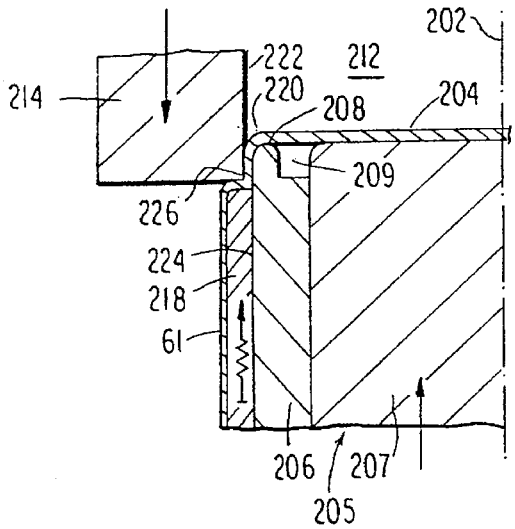

At the start of a new diameter formation in FIG. 20, a portion of such varying thickness juncture 216 substrate, designated 220, is adjacent to a side surface (punch nose) portion of contour 208. To facilitate the start of a new diameter, such partially heavier substrate portion 220 is in the space between die internal wall 222 and such side surface portion of contour 208; such space, which is larger in radial dimension than the clearance between die cavity wall and punch peripheral wall, leads into the controlled tighter clearance between cavity wall 222 and punch wall 224.

The work product side wall, which is at a decreased relatively uniform gage from the previous operation (station 57 of FIG. 3), is after such initial start clamped for side wall elongation. The clearance between punch wall 224 and cavity wall 222 is preselected for the specific embodiment. Such clearance is less than such side wall gage; the can stock must be elongated through such clearance in order to move from the cavity entrance zone 226 into the side wall as punch 205 moves into the cavity.

The cavity entrance zone 226 for this higher tension side wall elongation is formed about multiple radii of curvature of 0.012"/0.003"/0.012". The nose portion of contour 208 of punch 205 has a radius of curvature of about 0.050" to about 0.070". The substrate is elongated under tension by stretching about such sharp edge (0.003" radius) through the clearance provided between the cavity internal wall and the punch peripheral wall. Such elongation and thickness reduction by tension-elongation is free of side wall ironing and is free of "cold forging" (also referred to as surface "burnishing") aspects of side wall ironing. The clearance is selected at about 0.0045" for this third diameter-reduction operation of the specific embodiment for a twelve ounce beverage can; the resultant height of side wall 196 (of work product 195 FIG. 18) to flange 197 is about three and seven-eighths to about four inches.

Upon reaching a desired side wall height, clamping at flange 197 (FIG. 21) is released as male countersinking member 230 comes into contact with endwall 194 (FIG. 18); and, by coacting with recessed endwall contour means (such as 209 of punch 205) the countersunk endwall 199 (FIG. 18) is formed.

Such countersinking to form closed endwall configuration 199 is important to side wall thinning in the next stage (68 of FIG. 3). In such subsequent stage, the side wall is again elongated under high tension and the side wall metal is thinned through a selected clearance (about 0.004" in the final side wall forming operation of the specific embodiment). It is important, since planar clamping is to be exercised over a relatively small surface area, that such clamping be carried out on relatively uniform gage material.

Figure 21:
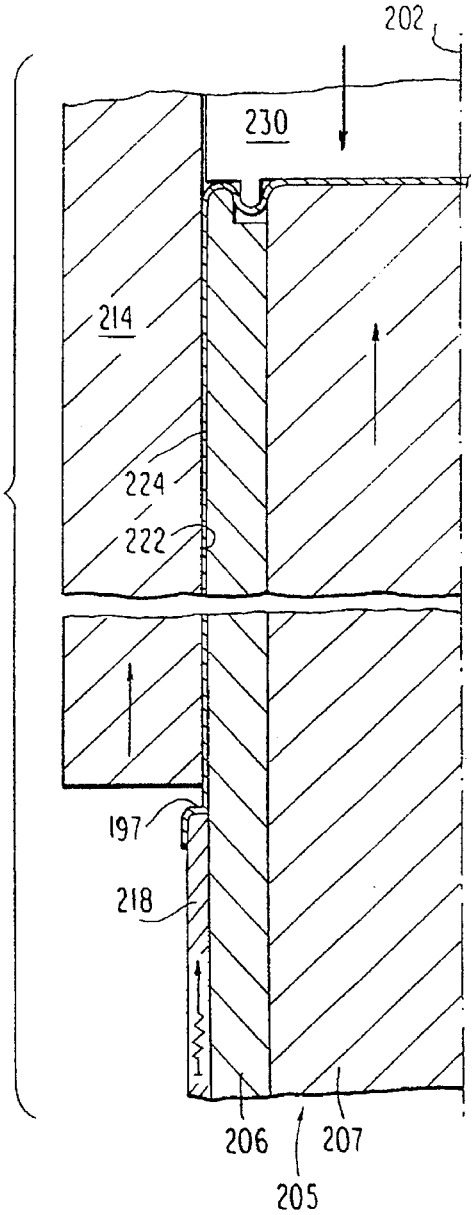

As the work product of FIG. 18 is formed in the die cavity before endwall countersinking, the substrate thickness at the juncture 220 is dimensionally in transition. The object of the countersinking of FIG. 21 is to move such "transition gage" substrate 220 into the endwall so as to avoid later clamping (FIG. 24) of non-uniform gage material in the final side wall reshaping operation to form the non-trimmed can body of FIG. 23. In such configuration of the final side wall reshaping operation, the radial dimension indicated at 200 is equal to the radial change in side wall cross section and defines flange 238 (FIG. 23).

With relatively small surface area planar clamping available, uniform gage metal is important for purposes of achieving desired side wall thinning. Such countersinking of the initial endwall configuration 194 (shown as interrupted lines in FIG. 18) into the countersunk configuration 199 is carried out after releasing flange clamping at the opposite end (FIG. 21). The latter enables the thicker material from the juncture to move into the endwall (out of the clamping range for the next diameter reduction operation). And, also, a controlled portion of the thinner, relatively uniform gage, side wall material to be "pulled" into the endwall 199 by such countersinking step. The resulting configuration peripheral of the endwall 199 is shown by the exploded cross-sectional view of substrate as shown in FIG. 22. The material clamped during the next operation will be at the relatively uniform side wall gage of the operation of FIG. 20. And, after the side wall diameter reduction portion of the next operation (FIGS. 24, 25), a controlled slightly heavier gage substrate will be in position as the "bottom rim" in the specific embodiment of a carbonated beverage can body configuration.

Referring to FIG. 22, a portion of side wall 196 has been pulled into the new peripheral portion 242 of the endwall; and, countersunk profile portion 244 presents what had been varying thickness gage transition zone substrate (previously 220 in FIG. 20); such substrate extends into the remaining panel portion 245 with increasing thickness equal to initial starting gage for the substrate.

Figure 23:
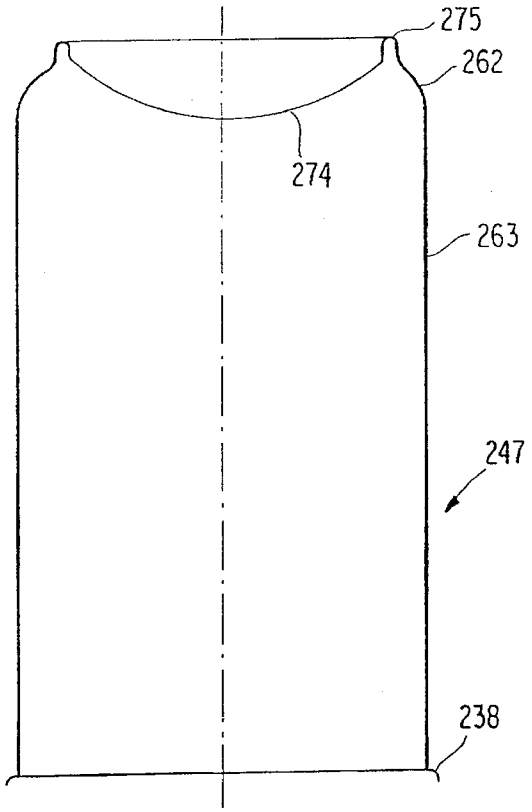
FIG. 23 is a cross-sectional view of a one-piece can body specific embodiment subsequent to a forming operation of the present invention on the work product of FIG. 18.

The final operation work product 247 of FIG. 23 depicts the final reduction in cross-sectional dimension at 263 and flange 238. Side wall substrate in approaching the flange has passed the sharp edge cavity entrance but does not have the full benefit of the stretch being provided to the remainder of the side wall and, thus can provide slightly thicker substrate (about 0.004"). Such slightly heavier substrate provides for subsequent necking and flanging of the trimmed can body and helps to avoid edge cracking during chime seam formation. Clamping takes place between the planar surface of clamping sleeve 250 (252 represents the reshaping radius) and the planar surface 254 of die 256 (FIG. 24).

At the closed endwall, inboard of such clamping, a portion of countersunk endwall 199 with varying thickness substrate, contiguous to location 244 in FIGS. 22 and 24, is reshaped gradually to form the rim 262, which is contiguous to the periphery of the closed end as shown in the cross-sectional view of FIG. 23.

In the embodiment as shown in FIG. 24, a portion of the substrate (from a radially outboard portion of 242 of FIG. 22) has been reshaped by clamping sleeve curved surface 252. In such embodiment, clamping sleeve 250 clamps can stock substrate which is at the relatively uniform thickness of the previous operation side wall (about 0.0045") to form a relatively small diameter reduction forming flange 238 (FIG. 23) at completion of the diameter reduction portion of this final stage. The planar portion of flange 238 is clamped between planar surface 254 of final die 256 and the planar endwall of clamping tool 250.

As such planar clamping takes place initially as shown in FIG. 24, punch 260 (which includes core 261, a bottom ring portion 261[*a*], and spacer 261[*b*]) moves in the relative direction indicated to side wall elongation; also, substrate at and near to location 244 as seen in FIG. 24 (which includes substrate at the slightly heavier gage indicated in FIG. 22) is in a position to form rim 262 (FIG. 25) along surface 265 (FIG. 24) of cone portion 267. Surface 265, in cross-sectional view is tapered toward the endwall and the central longitudinal axis; and, extends at an angle toward a "dolphin nose" shaping portion 268 (FIGS. 24, 25) of bottom ring 261[*a*].

The side wall substrate is thinned in gage (to about 0.0035" in the specific embodiment) by stretching through a radial clearance of about 0.004" between the internal cavity wall and the punch peripheral wall. And, side wall height is elongated to form the configuration of FIG. 23 while substrate from contiguous to the closed end "dolphin nose" to the side wall is of controlled thickness to add to the strength of rim 262; and, in a preferred embodiment, side wall substrate contiguous to the open end is slightly heavier (about 0.004") than the relatively uniform thickness thinned side wall major portion as tabulated for the specific embodiment; such slightly heavier substrate facilitates later formation of a chime seam after trimming of the FIG. 23 work product.

Figure 26:
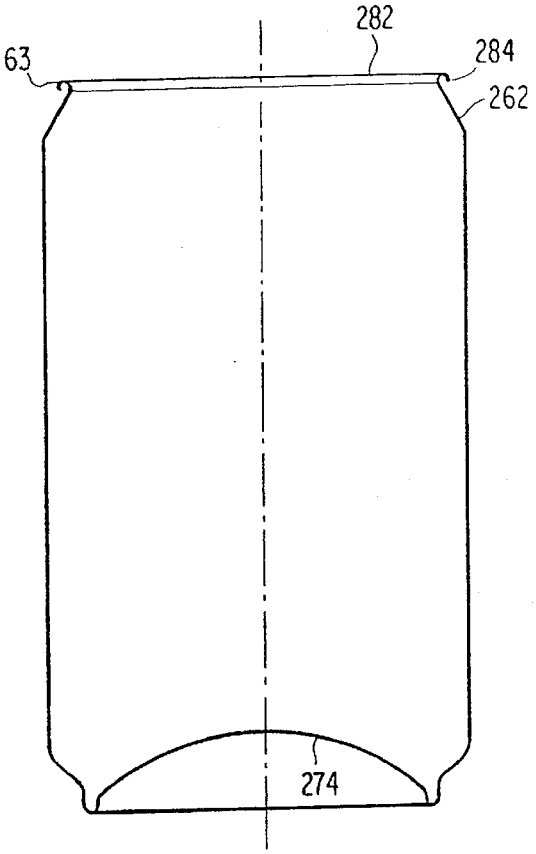
FIG. 26 is a vertical cross-sectional view of a specific embodiment of the invention with seamed end closure forming a two-piece carbonated beverage pack.

As side wall elongation is completed, clamping of flange 238 (shown in FIG. 23) is discontinued and endwall (dome) profile tooling 270 (FIG. 25), with relative movement as indicated, reshapes the planar endwall portion 272 of FIG. 24 forming the dome-shape 274 of FIG. 23; spring loaded rim tooling 266 holds the contour of rim 262 against the surface 256 of the rim portion 267 of core 261. The "dolphin nose" shaped portion 268 of punch insert 261[*a*] forms a bottom support 275 (FIG. 26), which in plan view presents a ring shaped configuration in a cylindrical-configuration side wall embodiment.

The data tabulated below relates to such specific embodiment utilizing 65#/bb double-reduced TFS precoated with protective organic coating and lubricant and, comprises substrate thickness data measurements carried out at a location in the rolling direction ("with grain") and at a location 90° to the rolling direction (90° to grain) around the perimeter of the can body. Such measurements were made along side wall height starting with the closed endwall 274 (FIG. 23) thickness (0.0073"–0.0074"); then at the rim 262 (0.0051") and continuing at ¼" intervals along side wall height to a height of 4¾".

The tabulated thickness of the closed endwall is within nominal gage for 65#/bb double-reduced flat-rolled steel which is 0.0072"±5% (about 0.0068" to about 0.0076"). The thickness of rim 262 is controlled as described earlier to provide desired anti-bulging strength between endwall support 275 and side wall 263. In the final side wall reshaping operation such material is lain, as described earlier, along tooling portion 266 between the peripheral wall 276 and dolphin nose 268 of punch 260 (FIG. 24).

Note in the tabulated data that the side wall substrate, from such rim to a location contiguous to the open end, has a thickness gage which is within about one to three ten thousandths of an inch of such 0.0035" value throughout such major portion of side wall height.

An average thickness within about two ten thousandths along about 85% to about 95% of side wall height defines the "relatively uniform side wall gage" achieved by the can body fabricating system taught herein. In the specific embodiment a final thickness along side wall height of about 0.0035" was the objective in preselecting the clearance between the cavity internal wall and the punch peripheral wall. Such 0.0035" represents a side wall gage reduction of about 52.5% in working with 0.0074" double-reduced TFS; and, the average departure is within about two ten thousandths (0.0002") from 0.0035" to provide relatively uniform gage over such major portion of side wall height.

Such "tension-regulated" side wall elongation achieves a uniformity of side wall gage in the fabrication of one-piece can bodies which had not been conceived of previously other than by side wall ironing. However, the new process disclosed is free of side wall ironing and free of "cold forging" or "burnishing" effects of side wall ironing which are completely detrimental to the integrity of a protective organic coating required for sheet metal canning of comestibles. The tension-regulated side wall elongation of the present invention achieves a decrease in side wall gage and a desired uniformity in side wall thickness without such disadvantages.

TABULATED DATA
Thickness Gage

| Side Wall Height | With Grain | 90° to Grain |
|---|---|---|
| 4-3/4 | .0040" | .0036" |
| 1/2 | .0038" | .0036" |
| 1/4 | .0036" | .0036" |
| 4" | .0036" | .0035" |
| 3-3/4 | .0036" | .0036" |

-continued

TABULATED DATA
Thickness Gage

| Side Wall Height | With Grain | 90° to Grain |
|---|---|---|
| 1/2 | .0035" | .0035" |
| 1/4 | .0035" | .0035" |
| 3" | .0035" | .0035" |
| 2-3/4 | .0034" | .0035" |
| 1/2 | .0034" | .0034" |
| 1/4 | .0033" | .0034" |
| 2" | .0035" | .0035" |
| 1-3/4 | .0035" | .0034" |
| 1/2 | .0035" | .0035" |
| 1/4 | .0035" | .0035" |
| 1" | .0036" | .0035" |
| 3/4 | .0034" | 10034" |
| 1/2 | .0037" | .0037" |
| Rim 1/4 | .0052" | .0051" |
| Closed endwall | .0074" | .0073" |

The surface area of such can body, after trimming such flange and contiguous metal, is about forty-five square inches; which is about 45% greater than the surface area of the 5.875" cut-edge starting blank. The percentage increase in surface area is greater when trimmed metal is considered; and, will increase as blank edge is optimized so as to decrease trim; or, will be increased by forming smaller diameter can bodies so as to provide a surface area which is in the range of about 40% to about 50% greater than the starting blank area. The relatively uniform thickness along the side wall is substantially uniform around the circumference at each such level; the increased thickness of about 0.005" near the closed end helps to prevent bulging of the rim.

In completing a can, the flange 238 and remaining metal leading to open end 282 (FIG. 26) are trimmed. Internal surface E-coat repair, if any, is carried out at E-coat station 74 (FIG. 3) which also includes curing of such E-coat; then, the can body is directed to necking and flanging apparatus 76 (FIG. 3) to form the necked-in portion indicated at 262 of FIG. 26 and the flange needed for the chime seam. Testing is carried out at 78. After filling, end closure structure 282 (FIG. 26) is applied by forming chime seam 284.

While specific materials, steps and dimensional values have been set forth for purposes of explaining this new can body fabricating technology, it should be recognized that changes in such specifics can be made in the light of the above teachings without departing from the concepts entitled to patent protection; therefore, for purposes of determining the scope of the patentable subject matter reference shall be made to the appended claims.

I claim:

1. Apparatus for fabricating, free of side wall ironing, precoated work-hardened flat-rolled steel into a one-piece thinned side wall can body comprising, in combination, source means for can stock providing a planar blank of predetermined peripheral cut-edge diameter, such can stock consisting essentially of work-hardened flat-rolled steel substrate of preselected starting gage which has been prepared for and precoated on both surfaces with organic polymeric coating and organic draw processing lubricant;

a plurality of press means for carrying out sequential diameter-reduction operations by draw forming a one-piece cup-shaped work product and redrawing such work product into such thinned side wall can body, such press means including a cupping press for forming such planar blank into a cup-shaped work product which presents a cylindrical configuration side wall, of preselected diameter, and an open end flange, such cupping press decreasing the cut-edge diameter of such planar blank about 35% to form such cylindrical configuration cup side wall, and a sequential side wall diameter-reduction redraw press means for decreasing the side wall diameter of such cupping press work product about 25%, such cup-shaped work product including a closed endwall, a cylindrical configuration side wall, a central longitudinal axis which is perpendicular to the geometric center of such endwall, with such side wall being symmetrically disposed with respect to such central longitudinal axis and defining an open end for such cup-shaped work product, a unitary juncture between the closed endwall and the cylindrical configuration side wall, the unitary juncture having a curved configuration as viewed in cross section in a plane which includes such central longitudinal axis, and a flange located at such open end of the cup-shaped work product, such flange being radially outwardly in transverse relationship to such central axis, as part of forming the cup-shaped work product, so as to provide a uniform side wall height for such cup-shaped work product;

substrate of such closed endwall having a thickness gage, substantially equal to such starting gage, over a major portion of its area extending from its geometric center toward its periphery contiguous to such side wall; with substrate of such side wall:

being substantially free of increase in gage above such preselected starting gage along side wall height, and being decreased in thickness relatively uniformly over a major portion of side wall height from contiquous to such unitary juncture to a location contiguous to such open end flange.

2. The apparatus of claim 1, in which such cupping press means decreases the thickness of such side wall substrate in the range of about 7.5% to about 15% in relation to such starting gage, and such sequential diameter-reduction redraw press means decreases side wall substrate thickness of such cup-shaped work product in the range of about 15% to about 25% in relation to such starting gage.

3. Apparatus for fabricating, free of side wall ironing, precoated work-hardened flat-rolled steel into a one-piece thinned side wall can body comprising, in combination, source means for can stock providing a planar blank of predetermined peripheral cut-edge diameter, such can stock consisting essentially of work-hardened flat-rolled steel substrate of preselected starting gage which has been prepared for and precoated on both surfaces with organic polymeric coating and organic draw processing lubricant;

a plurality of press means for carrying out sequential diameter-reduction operations by draw forming a one-piece cup-shaped work product and redrawing such work product into such thinned side wall can body, such cup-shaped work product including a closed endwall, a cylindrical configuration side wall, a central longitudinal axis which is perpendicular to the geometric center of such endwall, with such side wall being symmetrically disposed with respect to such central longitudinal axis and defining an open end for such cup-shaped work product, a unitary juncture between the closed endwall and the cylindrical configuration side wall, the unitary juncture having a curved configuration as viewed in cross section in a plane which includes such central longitudinal axis, and a flange located at such open end of the cup-shaped work product, such flange being disposed radially outwardly in transverse relationship to such central axis, as part of forming the cup-shaped work product, so as to provide a uniform side wall height for such cup-shaped work product;

substrate of such closed endwall having a thickness gage, substantially equal to such starting gage, over a major portion of its area extending from its geometric center toward its periphery contiguous to such side wall; with substrate of such side wall:

being substantially free of increase in gage above such preselected starting gage along side wall height, and being decreased in thickness relatively uniformly over a major portion of side wall height from contiguous to such unitary juncture to a location contiguous to such open end flange such press means including a plurality of presses, each respectively arranged for usage so as to decrease the diameter of such planar blank, and then to successively decrease the diameter of the cylindrical-configuration side wall of its respective cup-shaped work product, as received, with each such press including tooling members comprising a die defining a cavity disposed during such usage to confront one surface of such can stock, a punch having cylindrical configuration side wall for relative movement into such cavity, and a clamping means circumscribing such punch, such punch and clamping means being disposed to confront the remaining surface of such can stock, with such tooling members being disposed for relative movement in relation to each other while remaining in symmetrical relation to a centrally-located tooling axis, such tooling axis being coincident with the central longitudinal axis of the cylindrical configuration side wall of the can body being fabricated;

each such die including an internal die wall, for the die cavity, which is symmetrically disposed in relation to such centrally-located axis, a die endwall located peripherally of the die cavity, such die endwall, confronting such one surface of such can stock, presenting a planar clamping surface oriented in transverse relationship to such centrally-located longitudinal axis so as to provide for solely planar surface clamping of such can stock during movement of such punch into such die cavity, and a die cavity entrance transition zone, which is unitary with and extends between such die cavity internal wall and die endwall planar clamping surface, such die cavity entrance transition zone surrounding such die cavity so as to present a surface having a curved configuration, as viewed in a radial plane which includes such centrally-located axis, and in which such cavity entrance zone, as projected onto a plane perpendicularly transverse to such centrally-located axis, presents a radially-oriented linear dimension which is within a range of about half to about five times nominal starting gage for such flat-rolled sheet metal, such linear dimension is measured in such plane of projection.

4. The apparatus of claim 3, in which such curved surface of the cavity entrance zone of each die is formed about a plurality of radii of curvature so as to increase its curved surface area without increasing such projected linear dimension.

5. The apparatus of claim 4, in which each such die cavity internal wall presents a surface which, as viewed in cross section in a plane which includes such centrally-located axis, is tapered about one degree from contiguous to a point of intersection of such internal side wall with such curved surface of the cavity entrance zone, to provide a cavity of increasing cross-section area as measured in a plane which is perpendicularly transverse to such centrally-located axis, with increasing penetration of such cavity by such punch;

such punch including:

an endwall symmetrically disposed in relation to such centrally-located axis presenting at least a peripheral portion thereof defining a plane which is perpendicularly transverse to such centrally-located axis, a peripheral side wall which is symmetrically disposed with relation to such centrally-located axis of such punch; and, in which each such clamping means is symmetrically disposed in relation to such centrally-located axis as aligned for and during such draw processing, and such clamping means including an inner side wall which is contiguous to and circumscribes such punch side wall during usage, and an endwall presenting a planar surface enabling solely planar surface clamping of such can stock, with can stock clamping for such draw processing taking place by coaction between such planar surfaces of the die and clamping means such that relative movement of can stock into each such die cavity is carried out between such planar clamping surfaces.

6. The apparatus of claim 3, in which radial clearance between each such punch peripheral wall and each such respective cavity internal wall at such transition zone in each such sequential press means is less than starting gage for such sheet metal substrate, and such clearance is preselected for each such press responsive to the amount of side wall thinning carried out in each such sequential press means.

7. The apparatus of claim 3, in which such sheet metal substrate comprises double-reduced flat-rolled steel having a nominal starting gage of 0.0072";

such cupping press means decreases starting metal thickness in such side wall substrate means to about 0.0066", and such sequential diameter-reduction redraw press decreases side wall substrate is decreased to a thickness in the range of about 0.0055" to about 0.006", while such cup-shaped work product endwall substrate presents a planar portion at substantially starting thickness gage, and the substrate of such work product unitary juncture between endwall and side wall has a thickness in transition from such planar portion endwall thickness to such side wall thickness for each such cup-shaped work product.

8. The apparatus of claim 7, further including sequential press means for successive diameter-reduction redraw operations to achieve a predetermined diameter for such one-piece can body while elongating such work product side wall under tension to decrease such side wall substrate to a substantially uniform thickness selected in the range of about 45% to about 55% of such starting gage, with such substantially uniform side wall thickness extending over about 85% to about 95% of side wall height of such can body.

9. The apparatus of claim 8, further including endwall tooling means, operable in a diameter-reduction redraw press means, for countersinking a circular configuration portion of a cup-shaped work product endwall, such countersinking by such endwall tooling means acting to move side wall can stock from contiguous to such unitary juncture toward such endwall.

10. The apparatus of claim 3, in which substrate of such blank comprises double-reduced flat-rolled steel, of about 65 pounds per base box, composite-coated on both surfaces to include:

an electrolytically-applied coating for augmenting adhesion of a subsequent coating, and an organic polymeric coating and organic lubricant acceptable for use with comestibles; and such blank has a cut-edge diameter selected to enable fabricating a one-piece can body for a cylindrical-configuration can, with such plurality of sequential press means producing:

final can body diameter in the range of about two inches to about three inches, side wall height in the range of about four inches to about five inches, and side wall sheet metal substrate thickness over such major portion of such one-piece can body side wall height decreased to a thickness in the range of 0.0035" to about 0.004".

11. The apparatus of claim 10, in which the curved surface for such tooling set for decreasing such side wall to a thickness range of about 0.0035" to about 0.004" includes a die cavity entrance transition zone having a curved surface formed about multiple radii of curvature with radii dimensions of 0.012"/0.003"/0.012".

* * * * *

UNITED STATES PATENT AND TRADEMARK OFFICE

CERTIFICATE OF CORRECTION

PATENT NO. : 5,647,242

DATED : July 15, 1997

INVENTOR(S) : WILLIAM T. SAUNDERS

It is certified that error appears in the above-indentified patent and that said Letters Patent is hereby corrected as shown below:

Cover page, line 2 of the ABSTRACT, after "body" insert --which--;
line 5, after "out" insert --on--.

Column 1, line 6, "5,743,729" should read --5,343,729--;
line 13, after "abandoned)" insert -- and copending --

Column 5, line 26, delete "and" and substitute --which--.

Column 6, line 27, after "tension" delete the comma and substitute --and--.

Column 8, line 47, after "0.300" insert --"-- representing inch.

Column 9, line 50, "deceased" should read --decreased--.

Column 12, line 5, delete "Coaction between such" and substitute --Such--;
line 8, after "example" delete "; also" and insert --coacts with--;
line 9, delete "is used";
line 10, after "preferably" delete the comma.

Column 13, lines 1-13, the columns of the table are incorrectly aligned and should appear as follows:

UNITED STATES PATENT AND TRADEMARK OFFICE

CERTIFICATE OF CORRECTION

PATENT NO. : 5,647,242

DATED : July 15, 1997

INVENTOR(S) : WILLIAM T. SAUNDERS

It is certified that error appears in the above-indentified patent and that said Letters Patent is hereby corrected as shown below:

| | Work Product Diameter | Punch-Nose Radius | Cavity Diameter | Multiple Radii of Curvature For Cavity Entrance |
|---|---|---|---|---|
| Circular blank | 5.875" | -- | -- | -- |
| Shallow cup (FIG. 6) | 3.882" | .300" | 3.896" | .05"/.02"/.05" |
| Second cup (FIG. 14) | 2.986" | .200" | 2.998" | .05"/.02"/.05" |

Column 13, line 63, "radii" should read --radius--.

Column 14, line 65, "utilizes" should read --utilized--; line 66, delete second occurrence of "significantly."

Column 16, line 56, before "a" insert --enables--.

Column 22, line 66, delete "is decreased."

Signed and Sealed this

Sixteenth Day of December, 1997

Bruce Lehman

*Attest:*

BRUCE LEHMAN

*Attesting Officer*

*Commissioner of Patents and Trademarks*